US011448020B2

(12) United States Patent
Plano et al.

(10) Patent No.: US 11,448,020 B2
(45) Date of Patent: Sep. 20, 2022

(54) DRILLING SYSTEM AND METHOD

(71) Applicant: National Oilwell Varco Norway AS, Kristiansand S (NO)

(72) Inventors: Marco Plano, Obanos Navarra (ES); Roar Berge, Kristiansand S (NO)

(73) Assignee: National Oilwell Varco Norway AS

( * ) Notice: Subject to any disclaimer, the term of this patent is extended or adjusted under 35 U.S.C. 154(b) by 267 days.

(21) Appl. No.: 16/625,390

(22) PCT Filed: Jun. 18, 2018

(86) PCT No.: PCT/NO2018/050165

§ 371 (c)(1),
(2) Date: Dec. 20, 2019

(87) PCT Pub. No.: WO2019/004837

PCT Pub. Date: Jan. 3, 2019

(65) Prior Publication Data

US 2022/0003057 A1 Jan. 6, 2022

(30) Foreign Application Priority Data

Jun. 28, 2017 (EP) ..... 17178425

(51) Int. Cl.
*E21B 19/22* (2006.01)
*E21B 3/02* (2006.01)

(52) U.S. Cl.
CPC ..... *E21B 19/22* (2013.01); *E21B 3/02* (2013.01)

(58) Field of Classification Search
CPC ..... E21B 19/22; E21B 3/02
See application file for complete search history.

(56) References Cited

U.S. PATENT DOCUMENTS

| | | | | |
|---|---|---|---|---|
| 8,752,617 | B2 * | 6/2014 | Borst | E21B 19/22 166/77.1 |
| 2003/0106715 | A1 | 6/2003 | Clemmons | |
| 2006/0231268 | A1 | 10/2006 | Wood | |
| 2013/0121801 | A1 | 5/2013 | Gipson | |
| 2017/0089141 | A1 * | 3/2017 | Haci | E21B 19/08 |

OTHER PUBLICATIONS

Written Opinion dated Dec. 9, 2018 for PCT/N02018/050165 (6 pages).

* cited by examiner

*Primary Examiner* — Dany E Akakpo
(74) *Attorney, Agent, or Firm* — Conley Rose, P.C.

(57) ABSTRACT

Disclosed is a drilling system and a method for drilling a well. The drilling system includes a coilable drill string; a first reel for storing the coilable drill string; a drive means for driving the coilable drill string into the well from the first reel and out of the well to the first reel; and a deflection means for directing the coilable drill string between the first reel and into the well centre. The drilling system further includes a top drive. The coilable drill string is provided with: a first connection at a first end for connecting the coilable drill string to a bottom-hole-assembly and a second connection at a second end for connecting the coilable drill string to the top drive.

16 Claims, 18 Drawing Sheets

DRILLING SYSTEM AND METHOD

CROSS REFERENCE TO RELATED APPLICATIONS

This application is a 35 U.S.C. § 371 national stage application of PCT/NO2018/050165 filed Jun. 18, 2018 and entitled "Drilling System and Method", which claims priority to European Patent Application No. 17178425.9 filed Jun. 28, 2017, each of which is incorporated herein by reference in their entirety for all purposes.

STATEMENT REGARDING FEDERALLY SPONSORED RESEARCH OR DEVELOPMENT

Not Applicable.

FIELD OF THE DISCLOSURE

The present disclosure relates to a drilling system for drilling a well, the drilling system having a well centre through which a drill string may be run into and out of the well, said drilling system comprising a coilable drill string; a first reel for storing said coilable drill string; a deflection means for directing said coilable drill string from said first reel and into said well centre; and a drive means for rotating said first reel. The disclosure also relates to a method for operating the drilling system.

BACKGROUND

Drilling of a well is not a continuous process. During drilling, the drill string usually needs to be pulled out of and run back into the well numerous times before completion of the well. The retrieval and insertion of the drill string is e.g. done for replacing a drill bit because of wear or for changing the type of drill bit. The drill bit also needs to be removed from the well in order to allow for casing and cementing of the well. During a three months' drilling operation, it is not uncommon having to make 20 or more trips into and out of the well. The retrieval and insertion of drill pipe is commonly called tripping, and it is known to account for as much as up to of 40% of the total drilling time. The main reason for the great amount of time that it takes to make a trip out of and into the well, is that the drill string is made up of a great number of individual pipes that are connected by means of threaded connections. This is often referred to as sectional tubing. The pipes are typically removed from or added to the drill string in stands including 3 or 4 individual pipes with a total length of approximately 30 to 45 metres. Taking into account that an average well is in the order of 4000-6000 metres deep, that some wells are more than 10,000 metres deep, and that the wellhead of some subsea wells are located thousands of metres below sea level, this implies that a great number of stands need to been broken out from or added to the drill string for each tripping operation.

A top drive is used for lifting the string into and out of the well and for rotating the drill string from top-side in order to provide torque to the drill bit. The top drive, which is placed inside the drilling tower, commonly called a derrick, allows for powerful drilling with good torque control from topside. The torque that is transferred to the drill bit is also substantially independent of circulation of drilling mud down into the well through the drill string and back up through the annulus around the drill string. The circulation of mud is important for removing drill cuttings from the well, for cooling the drill bit, and for controlling the pressure conditions in the well. The main drawback of the top drive-based drilling is the long tripping times, which typically only allows for an average tripping speed of in the order of 0.3 m/s. Rotation of the drill string from top-side also reduces the friction for axial movements of the drill string.

Coiled tubing consists of one long string that is stored on a rotatable reel, and driven into and out of the well by rotation of the reel. Coiled tubing allows for retrieval and insertion of the drill bit at an average speed which is significantly faster than that of a drill string made up of sectional tubing. For drilling purposes, the coiled tubing commonly relies on a downhole motor driven by the circulation of mud. The torque on the drill bit then becomes directly proportional to the mud circulation rate and to the pressure difference across the motor, and it is not possible to optimize drilling performance independently of the flow and pressure conditions of the mud. Since only the drill bit rotates, whereas the rest of the drill string has to be slid into and out the hole, the risk increases for various drilling equipment to get stuck in the well due to increase friction. Also, downhole motors commonly have a significantly lower torque output than top drives.

Finally, providing the drill string as a long, heavy single piece of equipment also entails logistic challenges in terms of handling and transporting. Indeed, the reel with the coiled tubing needs to be lifted and moved together as one piece of equipment with a weight that may exceed 50 tons or more.

Hybrid drilling rigs are known that include both a top drive-based sectional tubing drilling system and coiled tubing drilling system and that allows switching between the two. One such system is described in U.S. Pat. No. 6,408,955 B2. However, with the hybrid drilling rigs according to the prior art, including in the one disclosed in U.S. Pat. No. 6,408,955 B2, one needs to choose between the sectional tubing drilling system and coiled tubing drilling system for each run into the well, and tripping and drilling operation will as such always include the drawbacks of one of the two drilling schemes; sectional tubing or coiled tubing.

The disclosure is directed to remedying or reducing at least one of the drawbacks of the prior art, or at least provide a useful alternative to prior art.

The drilling system and method according to present disclosure solve at least some of the above-mentioned problems by using a drill string that may be coiled on a reel while at the same time having sufficient torsional stiffness for allowing rotation from topside. This is solved practically by feeding the drill string into the well by rotation of the reel, similarly to normal coiled tubing. When the drill bit and bottom-hole-assembly reach the targeted depth, the coilable drill string is disconnected from the reel, leaving a stick-up that may be engaged by the top drive, typically via a stand. When pulling the drill string out of the well the operation is substantially reversed; the top drive is disconnected from the drill string, which is once again connected to the reel that may then spool in the drill string at a significantly higher speed than in normal tripping. The drilling system and method according to the present disclosure may as such be described as combining the advantages of sectional tubing top drive-based drilling with the advantages of coiled tubing, while at the same time, at least to a large extent, avoiding the drawbacks of the two schemes.

In a first aspect the disclosure relates to a drilling system for drilling a well, the drilling system having a well centre through which a drill string may be run into and pulled out of the well, said drilling system comprising:

a coilable drill string;

a first reel for storing said coilable drill string;

a drive means driving said coilable drill string into and out of the well; and a deflection means for directing said coilable drill string between said first reel and into said well centre; and, wherein the system further comprises:

a top drive;

an wherein said drill string is provided with:

a first connection at a first end thereof for connecting the coilable drill string to a to a bottom-hole-assembly; and a second connection at a second end thereof for connecting the coilable drill string to said top drive.

The first and second connections will normally be threaded connections, but other connections, such as clamped or wedged connections, may also be used.

The drive means, which may be a plurality of hydraulic, pneumatic or electric drive units/motors, may be adapted to rotate the reel so as to run said coilable drill string from said first reel, via the deflection means and into the well through the well centre and to pull said coilable drill string out of the well through the well centre, via said deflection means and onto said first reel. It should also be noted that the drive means do not necessarily need to be directly connected to and rotating the reel. The drive means may be any device adapted to pull the coilable drill string into or out of the well so as to indirectly rotate the reel. In one embodiment such an indirect rotation of the reel may be realized by means of a well tractor.

The first connection is adapted to connect the coilable drill string to a bottom-hole-assembly or to any other tool or pipe string that may need to be lowered into the well.

The second connection of said coilable drill string may be directly or indirectly connectable to the top drive. The well centre may be provided with means, so-called slips, for securely holding the drill string in the well centre before the reel is disconnected from the drill string. Disconnection is typically done by rotating the drill string from the well side, as opposed to the reel side, of the drill string as will be explained in more detail below. Once the reel is disconnected, a pipe handler/column racker may present a stand to the stick-up in the well centre. A connection between the stand and the stick-up may typically be made by a power tong/roughneck as will be understood by a person skilled in the art. The stand may be of equal diameter as the stick-up and the drill string in general or the stand may be of a different diameter. In the latter case an adapter/cross-over may be needed in order to connect the two parts. Finally, the top drive may connect to the stand, the slips may be released and drilling may commence.

In one embodiment said coilable drill string may comprise a composite material, such as carbon fibre or glass fibre or preferably a mix between the two. Such composite drill pipes have recently been shown to be very promising for drilling applications. The composite pipes have relatively small minimum bending radii, such as in the order of 6-7 meters, while at the same time having sufficiently high tensile and torsional capacity for common drilling applications, similar to that normally obtainable with some steel pipes. The composite pipes are light-weight compared to steel pipes, and they have shown high fatigue, wear and corrosion resistance, pressure performance and robustness to impact in general. One type of composite drill pipe that may be used for this application is the so-called Magma m-pipe® available from Magma Global Ltd. However, a variety of different composite pipes are available on the market. The m-pipe has so far been used for marine subsea risers, but has recently also been proven to be suitable for use in drill pipes. Advantageously, the amount of (S-2) glass fibre may be increased compared to the standard m-pipe, in order to increase the axial load carrying capability without impairing the minimum bending radius. In case the drill pipe is to be provided as sectional, composite tubing, also the end fitting, i.e. the threaded ends that make up the tool joints, may be provided in the same composite material. Another type of composite drill pipes that could be used for this application is available from the company Advanced Composite Products and Technology Ltd (ACPT). Composite drill collars and casings are also commercially available.

In another embodiment, the drill string may comprise or essentially consist of steel. When using steel pipes, as opposed to composited pipes, the drilling torque and load may have to be limited in order to let the pipe be able to coil with a minimum bending radius that is practical to handle. As an example, if using a 2⅜" (OD) Grant Prideco™ drill pipe, which is commercially available from National Oilwell Varco, the minimum bending radius is 15 metres, implying that the reel needs to have a diameter in the order of 30 meters, which may be unpractical in many applications. On the other hand, if using a conventional steel coiled tubing, such as QT-1300 with an OD of 2⅞", the coil would only have to be in order of 4 meters in diameter, though this would limit the available torque, In general, the design criteria for such a drilling system when using steel pipes will be a trade-off between the required torque and the size of the reel.

In one embodiment, the drill string may comprise a plurality of connected drill pipes, similarly to conventional sectional tubing. Composite drill pipes and smaller diameter steel pipes may be provided with threaded ends as in a normal sectional drill string. On the other hand, if using pipes commonly used for coiled tubing, the coiled tubing may be cut into sections connected by tool joints that allow transfer of substantially the full torque and yield ratings of the coiled tubing material. A person skilled in the art will be aware that joining of coiled tubing sections e.g. may be done by means of weld-on connectors or by means of slip type connectors that engages the outer diameter of the coil tubing section. In either case, the joint will normally represent a section with a larger outer diameter (OD) than the rest of the pipe. Preferably the reel may therefore be formed with recesses for accommodating the joints so as to avoid local stresses in the sectional drill string and allow for smooth spooling of the sectional drill string. It should also be noted that the joints of the sectional pipe string do not necessarily need to exceed the diameter of the pipe string itself.

In contrast to having a sectional drill string, the drill string may also be provided as a long, continuous unit with connections only at its end, alternatively as a few long sections with connections only at the ends. This embodiment will not give the same flexibility for connecting and disconnecting the reel from the drill string at basically any desired length, but may instead be used for a fixed tripping length for each run into and out of the well. On the other hand, a continuous, long coilable drill string may be easier to and less costly to implement, compared to a sectional, coiled tubing.

In one embodiment said deflection means may be skiable to and from said well centre. This may be beneficial for freeing space around the well centre when the deflection means is not in use, typically when top drive is engaged or is about to be engaged. Said deflection means may typically be a sheave or a part of the sheave that leads the drill string in the direction between the reel and the well centre. In an alternative embodiment, the deflection means may be a curved guide beam, similarly to that commonly used in so-called "goosenecks" in conventional coiled tubing injections. The deflection will be able to guide the drill string in various drilling system configurations, whereas in a preferred embodiment, the deflection means will change the direction of the drill string in the order of 90°. The deflection means may simply be slidable on a pair of rails/skid by means of an electric, pneumatic or hydraulic drive unit/motor. The motors may be push/pull units moving the deflection means step-wise along the rails.

In a drilling system according to the first aspect of the present disclosure, the top drive may connect to the coilable drill string via drill stand. The drill stand will typically be latched to the well centre by means of a pipe handler/racker. The drill stand may then be connected to the second end, the stick-up, of the coilable drill string. The drill stand may be of the same material and/or diameter and minimum bending radius as the coilable drill string or said drill stand may be provided with/from a different diameter and/or material and minimum bending radius. In case of different diameters and/or thread pitch the drill stand may connect to the coilable drill pipe via an adapter/cross-over.

In one embodiment, the drilling system according to the first aspect of the disclosure may further comprise a second reel for storing a coilable string, wherein said coilable string may be a drill string or a wire rope. This may be beneficial for being able to switch between a coilable drill string with a first configuration to a coilable drill string of a second configuration or to be able to switch between a coilable drill string and another coilable string, such as a lifting string. A lifting string, such as a steel wire rope, may be used for lifting particularly heavy equipment, such casing and BOPs. In another embodiment the lifting string could be a thick-walled pipe allowing for circulation of mud therethrough, which may be needed in some lifting operations to maintain control of the well. Each of the first reel and the second reel may be slidable on skids to and from an operational position and an idle position. The drilling system may also comprise further reels than the mentioned first and second.

The first reel in the drilling system may be provided with a diameter in the range of 10-15 metres, preferably around 13 metres, which may be particularly useful in combination with coiled composite pipes. However, as mentioned above, the first reel may be significantly larger than 15 meters should this be practical, and it may also be made smaller than 10 meters, in particular in applications that do not require high drilling torques. The second reel may be of a similar diameter or a different diameter than the first reel. In an embodiment where the second reel stores landing strings for heavy lifting operations, the diameter of the second reel may be larger than that of the first reel. In particularly deep wells, often also provided in deep water, it may be necessary to use two or more reels in order to provide a drill string that is sufficiently long.

The drilling system may further comprise cooling and/or lubrication means. The deflection means, where the coiled drill pipe is bent into the well centre, is an area where a lot of friction may occur, both between the coilable drill pipe and the deflection means but also internally in the coilable drill pipe. It may therefore be advantageous if coilable drill pipe and/or deflection means is cooled and/or lubricated in order to cool and reduce friction, respectively. This cooling and/or lubrication may be implemented by providing an enclosure over or around the deflection means, where a coolant or lubricant is pumped onto the coilable drill string and/or deflection means. A drilling system including such cooling and/or lubrication means may preferably also be provided with a drain for the coolant and/or lubricant. Preferably the drain will be provided with or connected to a pump enabling circulation and re-use of the coolant and/or lubricant. Cooling may be done by means of water- or electrolyte-based liquids, air jets or other cooling fluids. In an alternative embodiment, cooling of the coilable drill pipe may be realized by pre-cooling the mud circulated down into the coilable drill pipe.

There is also described herein a drilling rig comprising a drilling system according to the present disclosure. The drilling system may be provided both on offshore rigs and land-based rigs. Offshore rigs may include bottom founded drilling rigs (jack-up barges and swamp barges), combined drilling and production facilities either bottom founded or floating platforms, and deepwater mobile offshore drilling units (MODU) including semi-submersibles and drill ships.

There is also described herein a drilling system according to the first aspect of the invention, wherein the top drive is providable at any angle relative to the well centre. The top drive is normally provided vertically above the well centre. In European patent application EP17178322.8 is disclosed a drilling system wherein the top drive ("torque exerting means") is adapted to provide torque to bendable drill pipes while being oriented in any direction, including horizontally, i.e. with the length axis of the pipe oriented substantially perpendicularly, relative to the well centre. The top drive will then be provided between the reel and the deflection means. EP17178322.8 is hereby incorporated by reference.

In a second aspect, the disclosure relates to a method for operating a drilling system according to the first aspect of the disclosure, said method including the steps of:

- placing said first reel and said deflection means in an operating position;
- connecting said first end of the coilable drill string to a bottom-hole-assembly;
- spooling out said coilable drill string from the first reel for lowering said bottom-hole-assembly into the well;
- reaching a target depth;
- securing said coilable drill sting in said well centre;
- disconnecting said reel from said second end of the coilable drill string; and
- connecting said top drive to said second end of the coilable drill string.

It should also be noted that the method may equally well be exploited with any tool or pipe string that may need to be lowered into the well, instead of the bottom hole assembly.

A person skilled in the art will know that before drilling a well, the seabed (or ground if land-based), and wellhead need to be prepared. The preparation steps will not be described in detail herein, but it should be noted that the system and method according to the first and second aspects of the disclosure may also be used during the preparation phase. The method according to the disclosure may commence when the well is ready to be drilled. When the well is ready to be drilled, the deflection means and reel are slid/skidded into their operating positions. The first end of the coilable drill string is connected to the bottom hole assembly with the drill bit that is to be lowered into the well. The drill string is spooled out by rotation of the reel so as to lower coilable drill string and the bottom hole assembly and drill bit into the well. When the bottom hole assembly has reached a desired depth, the slips in the well centre are set, and the coilable drill string may be disconnected from the reel, leaving a stick-up in the well centre. A drill stand is brought into the well centre by means of a pipe handler/column racker, and connected to the stick-up, potentially via a cross-over in case the stick-up and drill stand are of different diameters. The connection is made with a roughneck. The top drive is then finally latched to the drill stand and drilling may commence by rotation of the coilable drill string from topside. After an initial drilling phase, normally after a few hundred metres of drilling (but it could be anything from a few meters to a few kilometres), the drilling tools will typically have to be removed (trip out) from the well in order to lower cementing and casing tools into (trip in), whereby the process discussed above is reversed.

In one embodiment of the method, the step of disconnecting said reel from said second end of the coilable drill string may include the step of rotating the coilable drill string on the well-side of the drill string, as opposed to the on the reel side, while keeping said coilable drill string substantially fixed on the reel side of the drill string.

Details about how the coilable drill string may be connected to the stick-up in the well centre in the first place, and how the connections of the coilable drill pipe may be made up and broken out will be discussed in the following with reference to the drawings.

BRIEF DESCRIPTION OF THE DRAWINGS

In the following are described examples of preferred embodiments illustrated in the accompanying drawings, wherein.

DETAILED DESCRIPTION OF THE DISCLOSED EXEMPLARY EMBODIMENTS

Figure 1:
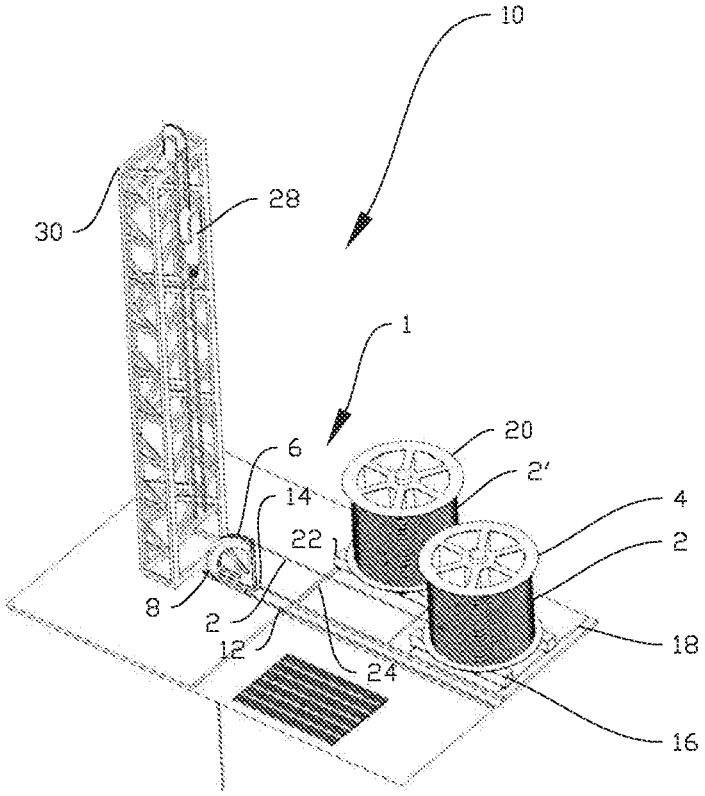
FIG. 1 shows a drilling system according to present disclosure in a first position of use.

In the following the reference numeral 1 will indicate a drilling system according to the present disclosure, whereas the reference numeral 10 indicates a drilling rig comprising such a drilling system. Identical reference numerals will indicate identical or similar features in the drawings. The figures are drawn simplified and schematically and various features therein are not necessarily drawn to scale.

Figure 7:
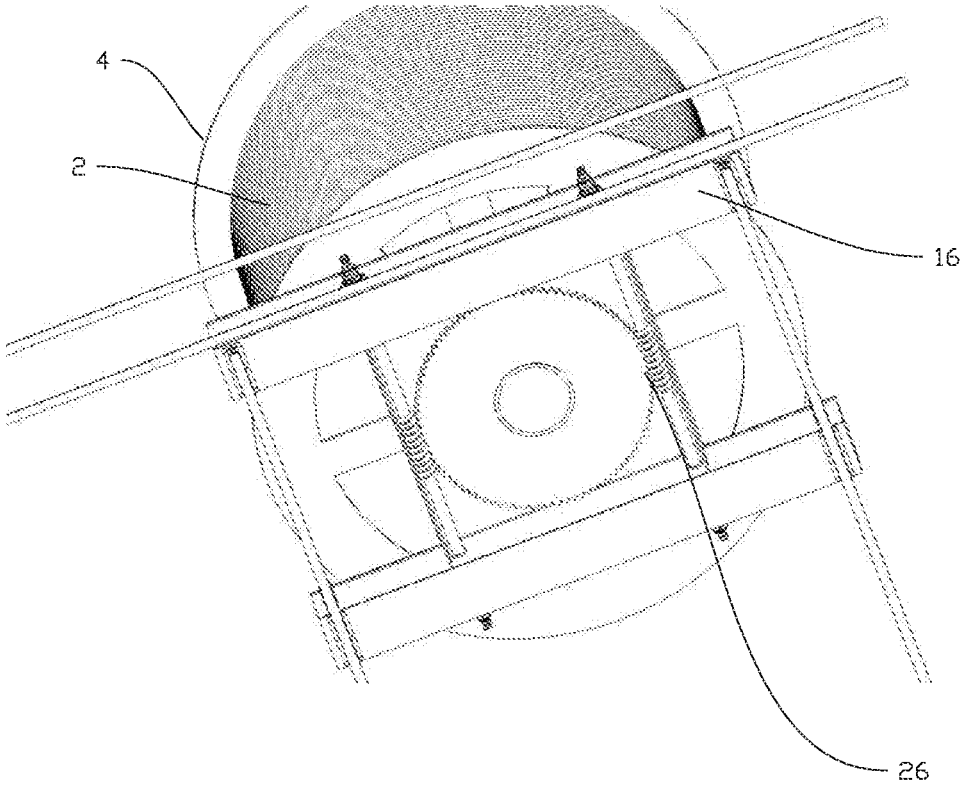

FIG. 1 shows a first embodiment of a drilling system 1 according to the present invention as provided as part of a drilling rig 10. A coilable drill string 2 is stored on first reel 4 and extends from the first reel 4 and over a deflection means 6, here shown in the form of a quarter circular sheave, and into a not shown well through a well centre 8. In the shown position of use, the sheave 6 is placed next to the well centre 8. When the sheave 6 is not in use, as will be indicated in FIGS. 4 and 5, the sheave 6 is skid away from the well centre 8. The sheave 6 is placed on a base 14 that can skid away from and towards the well centre 8 on rails 12 in order to place the sheave 6 near the well centre 8 when needed to deflect the coilable drill string 2 from a horizontal direction and to a vertical direction through the well centre 8. The first reel 4 is placed on a base 16 adapted to skid towards and away from the horizontal part of the firing line through the well centre 8 on rails 18, i.e. perpendicularly to the skidding direction of the sheave 6. In the shown embodiment, the first reel base 16 and the sheave base 14 are movable by means of not shown push/pull hydraulic actuators. In the shown embodiment, the drilling system 1 further comprises a second reel 20 placed on a second base 22 adapted to skid towards and away from the firing line on rails 24 parallel to the rails 18 on which the first reel base 16 is placed. Having more than one reel may be beneficial for being able to switch between a coilable drill string 2 with a first configuration to a coilable drill string 2' of a second configuration or to be able to switch between a coilable drill string and another coilable string, such as a lifting string. It should be noted that the defection means 6, shown schematically as a quarter of a circular sheave, may in certain embodiments utilize the inner, concave part of the sheave 6 as opposed to the outer, convex part in order to control the bending of the coilable drill pipe. In the shown embodiment the first reel 4, as well as the sheave 6, are provided with a radius of approximately 6.5 metres, corresponding to the minimum bending radius of the coilable drill string 2, which is provided in a composite material. In FIG. 1, the coilable drill string 2 is driven into the well through the well centre 8 by actively rotating the first reel 4 by means of a not shown drive means in the form of hydraulic motor rotating the reel via a worm gear transmission 26 as indicated in FIG. 7. A top drive 28 suspended from a derrick 30 is idle during the tripping operation, but will be engaged after the target tripping depth has been reached, as will be explained in the following.

Figure 2:
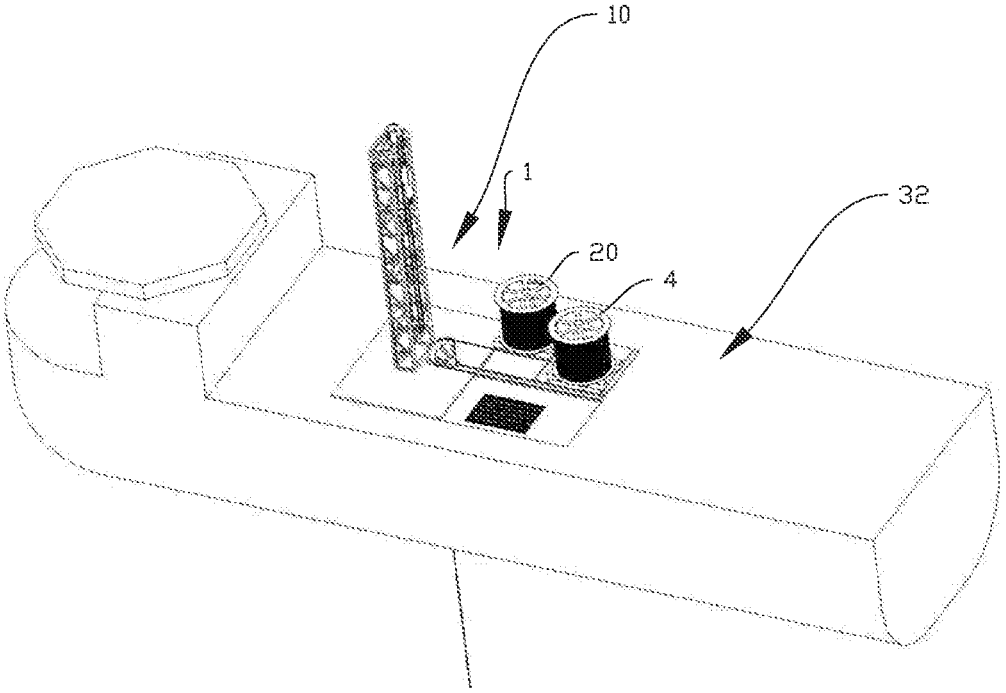
FIG. 2 shows a drilling system according to the present disclosure provided on a vessel.
Figure 3:
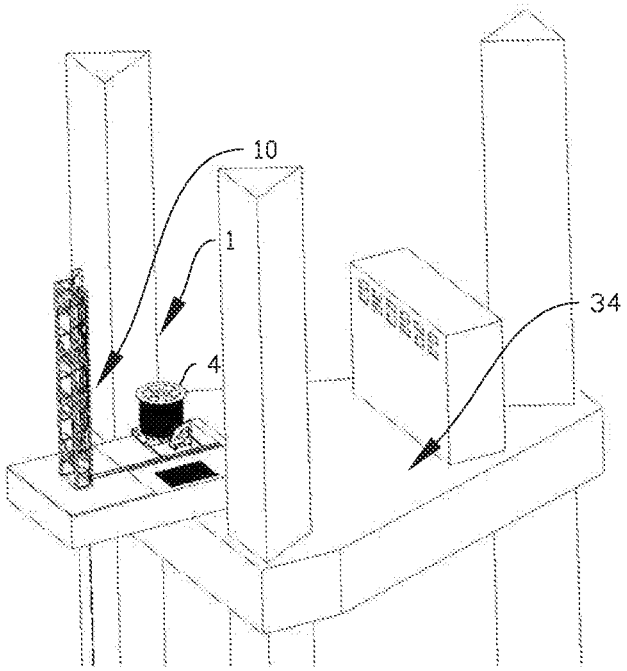
FIG. 3 shows a drilling system according to the present disclosure provided on a jack-up rig.

FIGS. 2 and 3 show two possible uses of drilling systems 1 according to the present disclosure as used in a drilling rig 10 placed on a drillship 32 and a jack-up platform 34 respectively. The drilling system 1 on the jack-up platform 34 only comprises one reel 4, whereas the drilling system 1 on the drillship comprises first and second reels 4, 20 similarly to the embodiment shown in FIG. 1.

Figure 4:
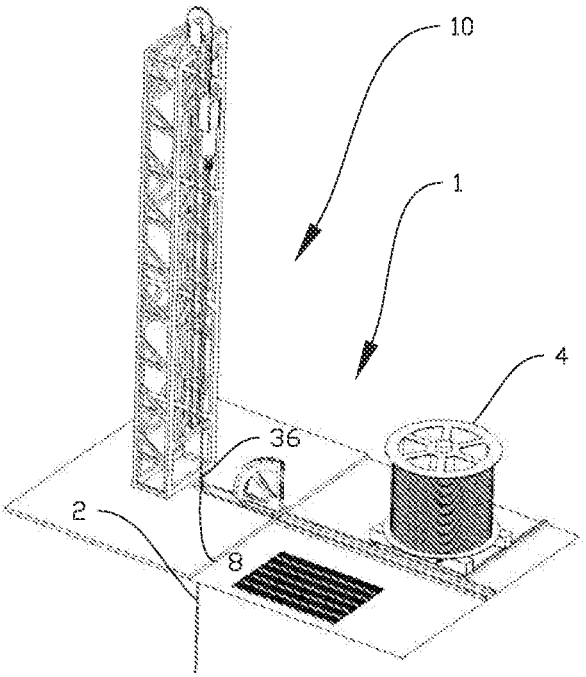
FIGS. 4-5 shows a drilling system according to the present disclosure in a second and third position of use, respectively.

Once the target depth has been reached in the well, the coilable drill string 2, if any remains on the first reel 4, needs to be disconnected from the part of the coilable drill string 2 that has been run into the well as will been shown in the following figures. In one embodiment the full length of the coilable drill string 2 is run into the well, while in another embodiment a joint of the coilable drill string 2 is broken up in order to separate the part of the coilable drill string 2 run into the well from the coilable drill string 2 on the first reel 4, as will be explained in the following. In both embodiments a stick-up 36 remains at the well centre 8, as shown in FIG. 4.

Figure 5:
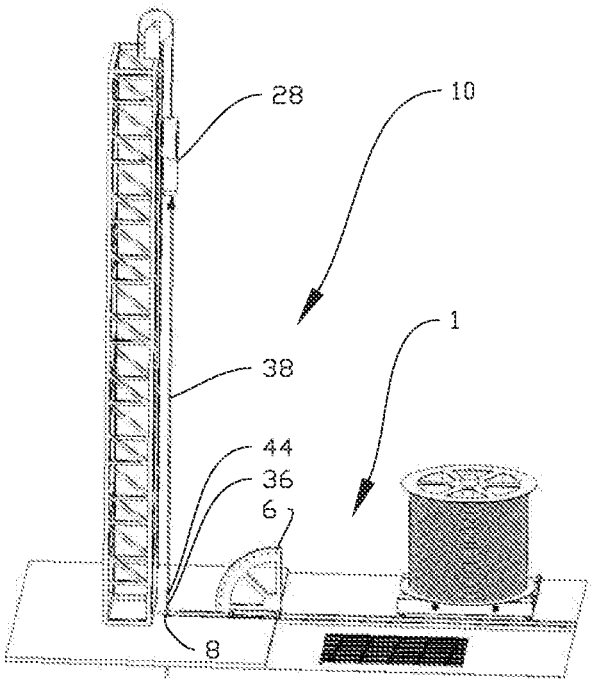

FIG. 5 shows and embodiment of the drilling system 1 according to the first aspect of the disclosure, wherein the top drive 28 has connected to the stick-up 36, corresponding to a second end 44 of the coilable drill string 2, via a drill stand 38. The sheave 6 has been skid away from the well centre 8 and drilling may commence by rotating the drill string 2 by means of the top drive 28.

Figure 6:
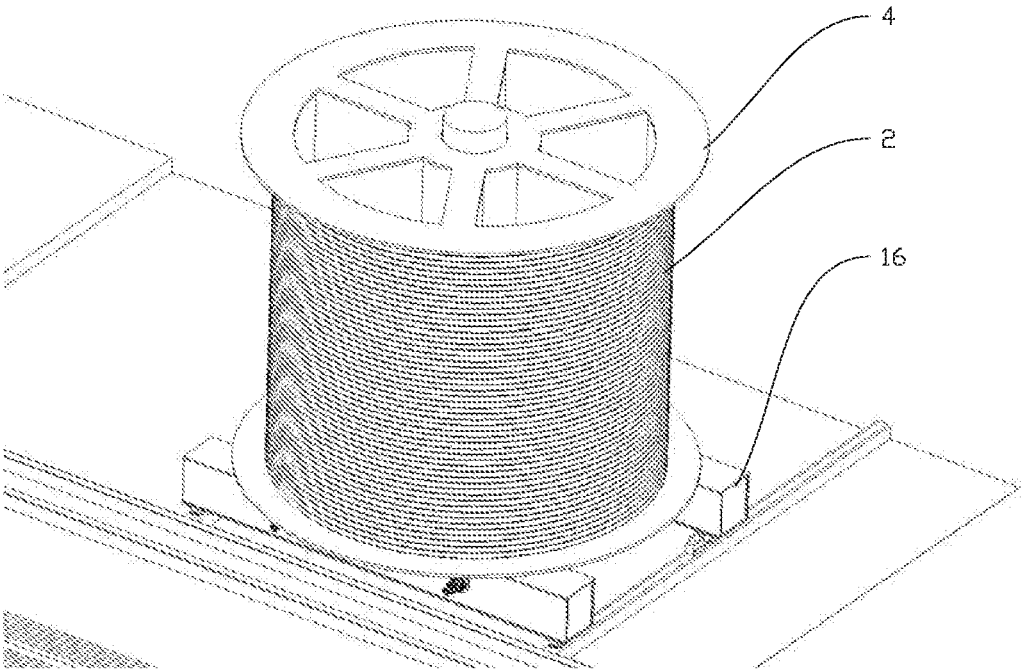
FIGS. 6-7 shows details of a reel as included a drilling system according to the present disclosure.

FIGS. 6 and 7 show further details of the first reel 4 on which the coilable drill string 2 is stored. The first reel 4 is rotatably stored on the base 16, and rotation is enabled by means of the worm drive 26, as mentioned above.

Figure 8:
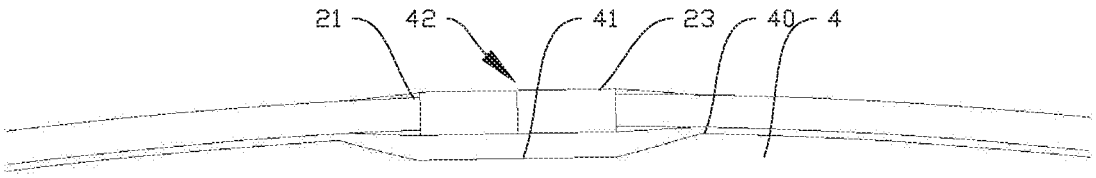
FIG. 8 shows a detail of a coilable drill string on a reel.
Figure 9:
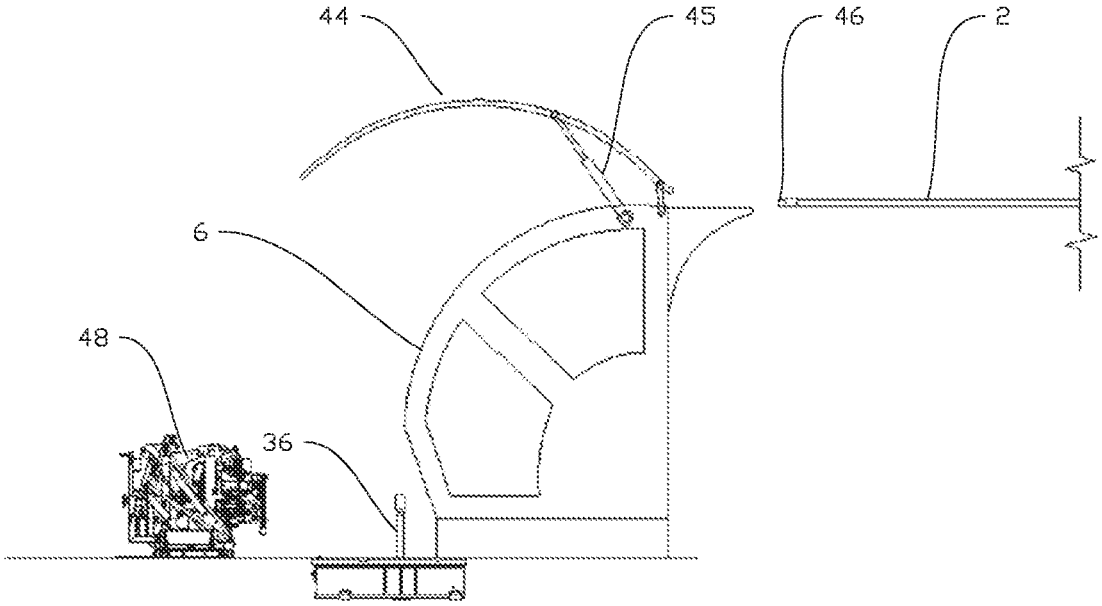
FIGS. 9-12 shows a process of bending a coilable drill string over a sheave with a movable lid for connecting a coilable drill string to a stick-up at the well centre.
Figure 10:
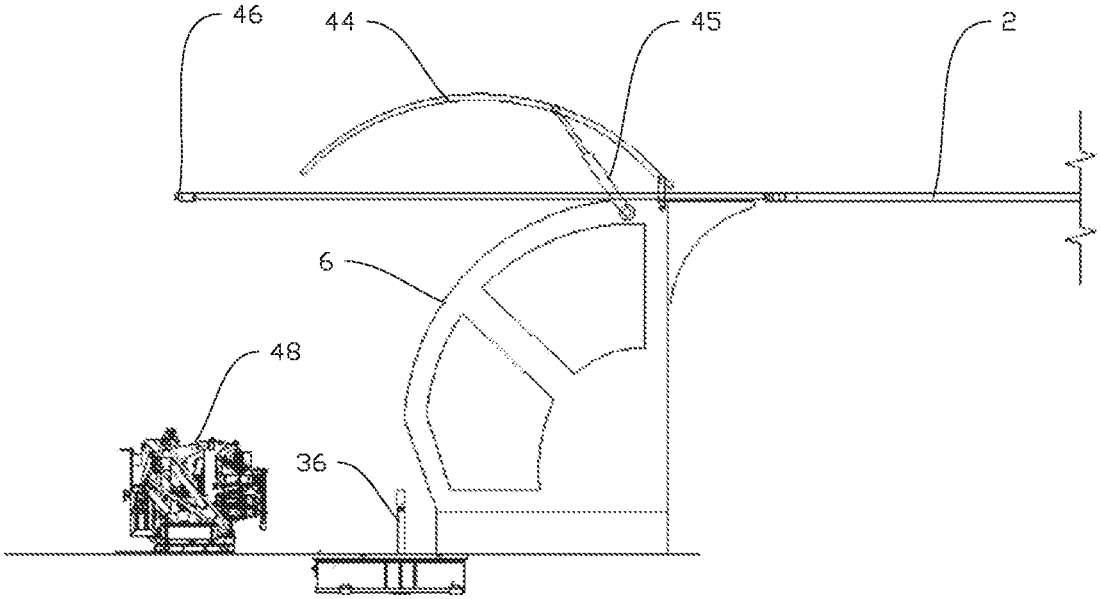

FIG. 8 shows a detail of one embodiment of a first reel 4, wherein the outer surface 40 of the reel is provided with recesses 41, only one of which is shown in the figure, for accommodating joints 42 between portions 21, 23 of the coilable drill string 2. This may be useful where the coilable drill string 2 comprises two or more portions and where the joint(s) have a larger diameter than the rest of the coilable drill string 2 as was discussed above.

Figure 11:
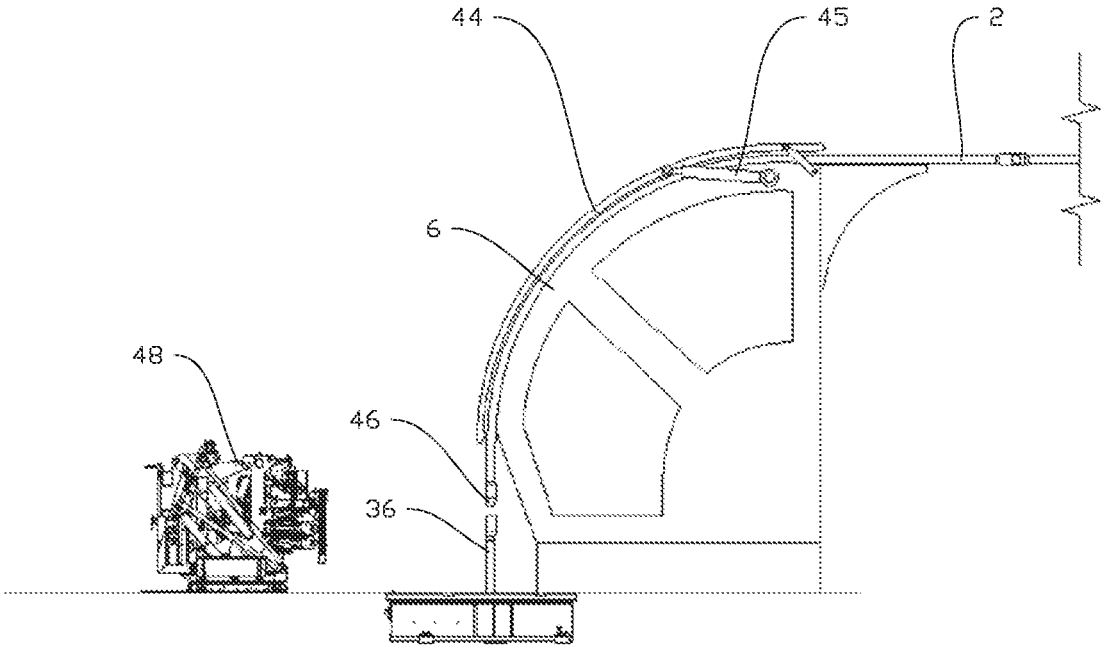

FIGS. 9 to 12 show one embodiment of the process of driving a first end 46 of the coilable drill string 2 from the first reel 4, over the sheave 6 and down towards the stick-up 36 in the well centre 8, the stick-up 36 being a part of a not fully shown bottom-hole-assembly. In order to obtain the desired deflection of the coilable drill string 2, sheave 6 provided with a bending means 44, here in the form of a movable cover, for forcing the coilable drill string 2 to bend over the sheave 6 and towards the drill centre 8. The cover 44 is movable my means of hydraulic actuators 45 rotatably hinged to the sheave 6. In order to bring the first end 46 of the coilable drill string 2 from the first reel 4 (not shown in these figures) and onto the sheave 6, it may be necessary to support the first end 46 of the coilable drill string 2 with not shown support means, such as a not shown lifting wire from a crane, that typically will be available on a platform or drilling vessel. The support means may operate in combination with the drive means for rotating the first reel 4. After the coilable drill string 2 has been bent into position, as indicated in FIG. 11, an iron roughneck 48 approaches the well centre 8 and engages the joint between the first end 46 of the coilable drill string 2 and the stick-up 36 to make up the connection. After the make-up of the joint, the coilable drill sting 2 is ready to be tripped into the well by rotation of the first reel 4, similarly to tripping with traditional coil tubing, as described with reference to FIGS. 14-15 below.

Figure 13:
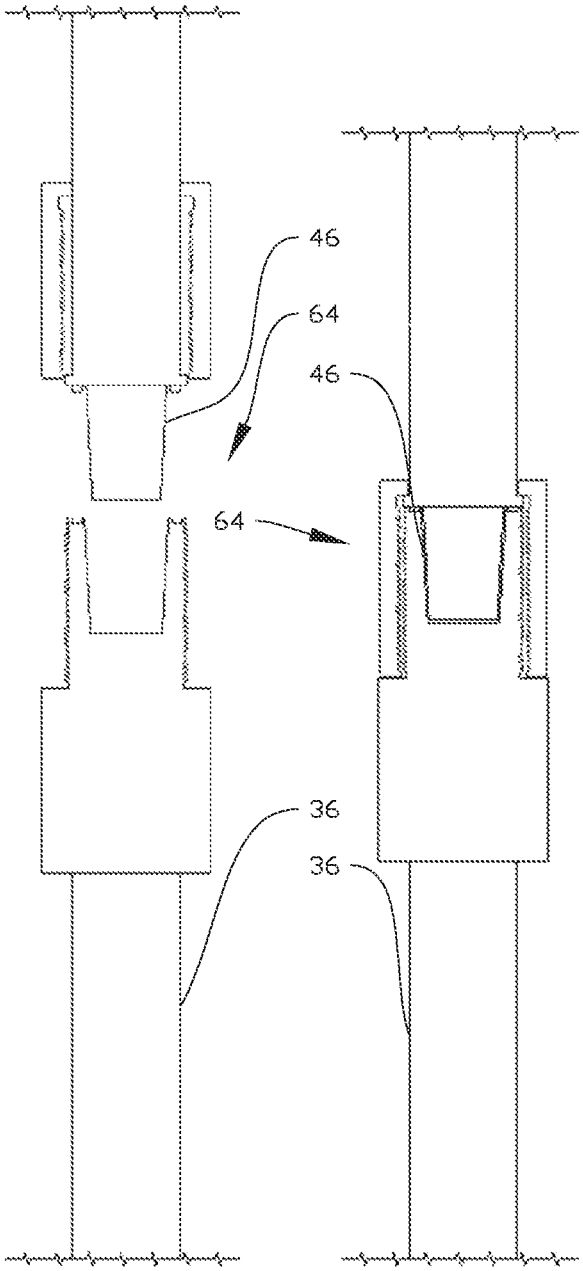
FIG. 13 shows details of one embodiment a connection joint between a coilable drill string and the stick-up at the well centre.

FIG. 13 shows one embodiment of a sleeved tool joint 64, which may be used to connect the first end 46 of the coilable drill string 2 to the stick-up 36. The shown sleeved toil joint 64 does not require any rotation of the first end 46 of the coilable drill string 2 relative to the stick-up prior to making up our breaking out the joint, which may be done with an iron roughneck 48, as indicated in the figures, or by means of a casing tong.

Figure 12:
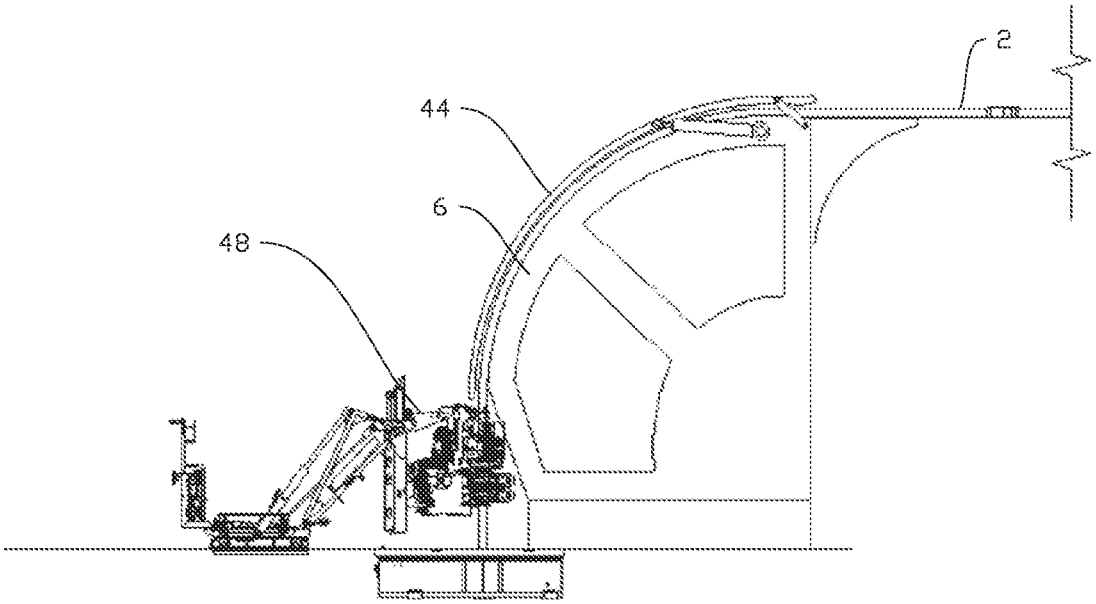
Figure 14:
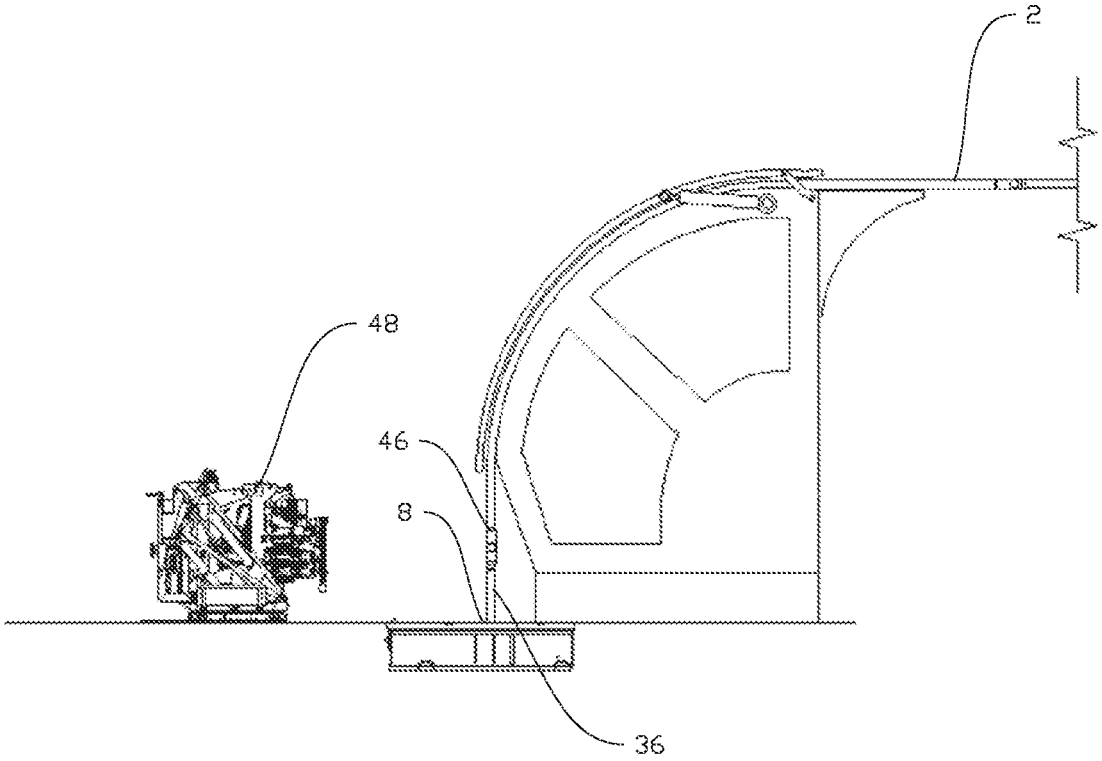
FIGS. 14-15 shows the process of spooling the coilable drill string into the well through the well centre.
Figure 15:
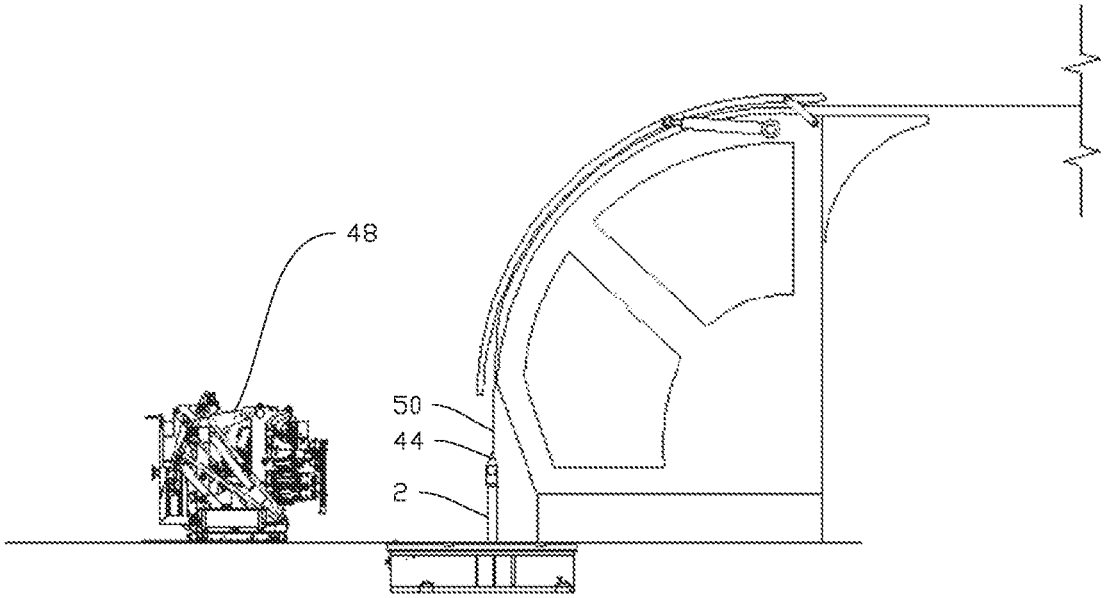

FIGS. 14-15 show the process of spooling the coilable drill string 2 from the first reel 4 (not shown in these figures) and into the not shown well via the well centre 8. After having made up the joint between the first end 46 of the coilable drill string 2 and the stick-up 36 part of the bottom-hole-assembly, as shown in FIG. 12, the iron roughneck 48 retracts from the well centre as indicated in FIG. 14. In the shown embodiment of FIGS. 14 and 15, a lifting wire 50 is connected to the second end 44 of the coilable drill string 2, for securely guiding the last portion, including the second end 44, of the coilable drill string 2 towards the well centre 8.

Figure 16:
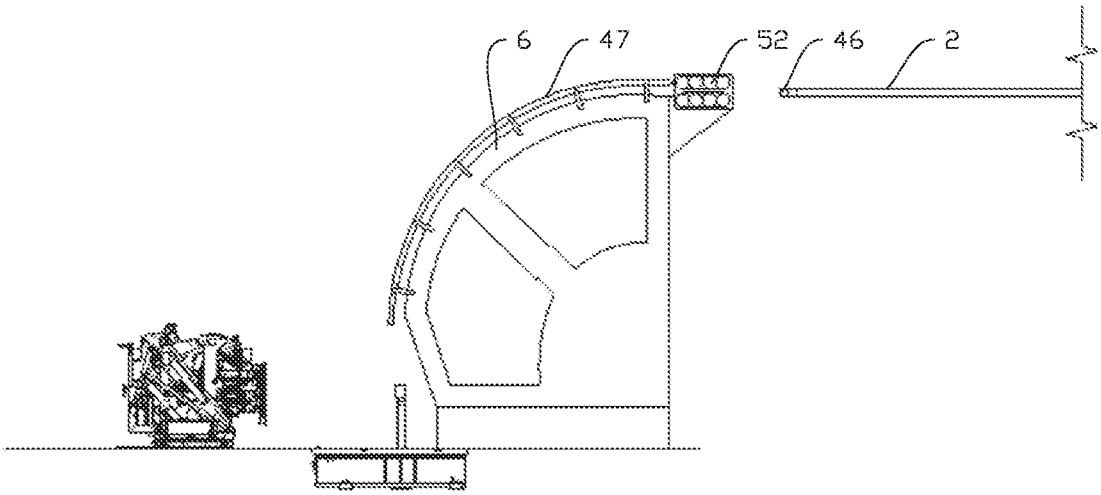
FIG. 16 shows an alternative embodiment of a deflection means with a fixed lid.

FIG. 16 show a different embodiment of a sheave 6, as used in a drilling system 1 according to the disclosure. Instead of the movable cover 46 shown in the previous figures, the sheave 6 is provided with a fixed cover 47 through which the coilable drill string 2 is forced in order to be bent against the inner concave portion of the fixed cover 47. In the shown embodiment, the sheave 6 is also provided with drive means in the form of a set of rollers 52 for actively driving the coilable drill string 2 through the space between the sheave 6 and the fixed cover 47. A support means, such as a not shown winch and lifting wire may be used to bring the first end 46 of the coilable drill string 2 into contact with the rollers 52. The rollers 52 may operate in combination with or instead of other drive means mentioned herein for driving the coilable drill string 2 into the well.

Figure 17:
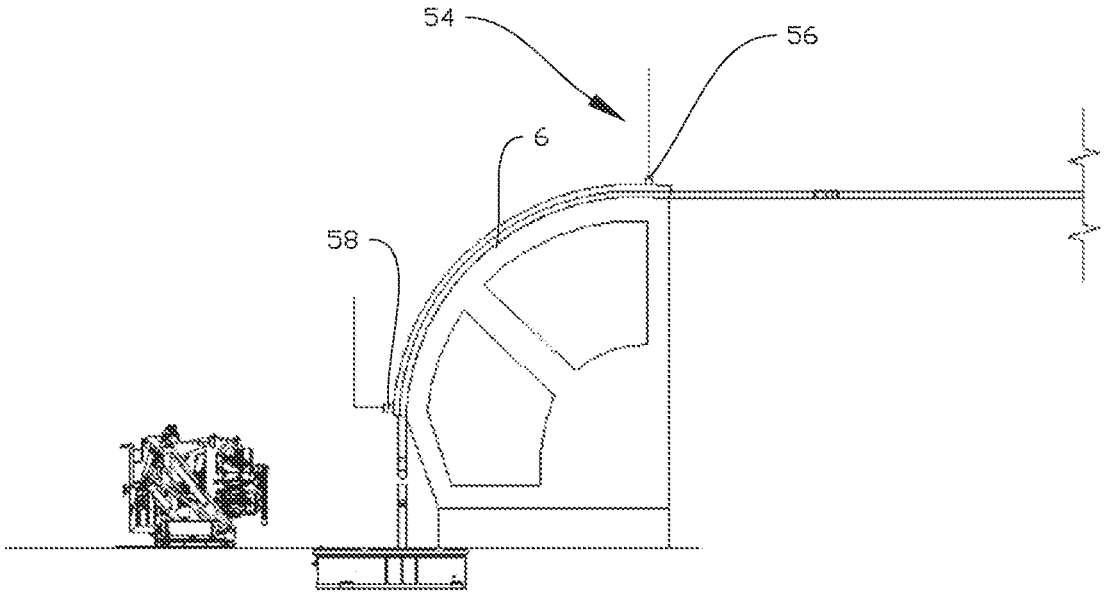
FIG. 17 shows a deflection means with integrated cooling and lubrication means.

FIG. 17 shows an embodiment of a deflection means 6 provided with cooling means 54 for cooling the coilable drill string 2 in the deflection zone, which is typically an area where a lot of friction, and thereby also heating, may occur. An inlet 56 for a coolant is provided at an upper portion of the deflection means 6 whereas and outlet 58 for the same coolant is provided at a lower portion of the deflection means 6. The coolant may be circulated through deflection means 6, such as in the cover. The cooling system 54 may in addition or as an alternative be used to lubricate the coilable drill string 2.

Figure 18:
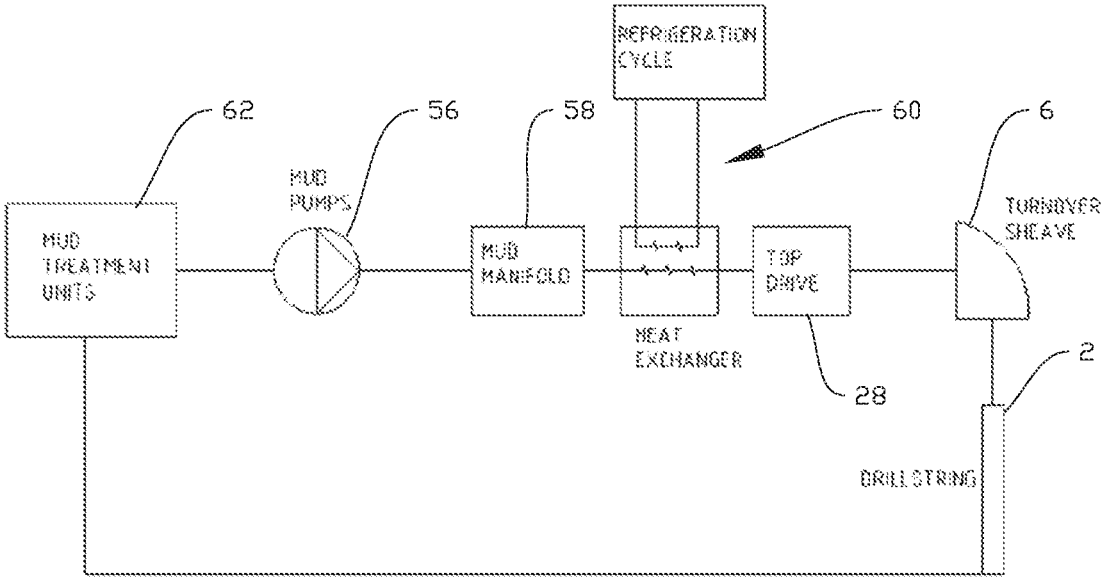
FIG. 18 shows schematically process of cooling drilling mud.

In addition or as an alternative, cooling of the coilable drill string 2 may also be effectuated indirectly by cooling the drilling mud circulating therethrough during operation. FIG. 18 shows schematically one possible way of cooling the drilling mud, where the mud flows from a mud pump 56, through a mud manifold 58 and to a heat exchanger through which a cooling fluid is circulated in refrigeration circle 60. From the heat exchanger the mud flows through the top drive 28, though the coilable drill string 2, over the deflection means 6 and into the well. From the well it is circulated back up, in an not shown annulus between the outside of the coilable drill string 2 and a not shown casing, top-side to a mud treatment unit 62 from which treated mud is extracted by means of the mud pump 56, whereby circulation continues.

It should be noted that the above-mentioned exemplary embodiments illustrate rather than limit the claimed invention, and that those skilled in the art will be able to design many alternative embodiments without departing from the scope of the invention as defined by the claims that are set out below. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. Drilling system for drilling a well, the drilling system having a well centre through which a drill string may be run into and pulled out of the well, said drilling system comprising:

a coilable drill string;

a first reel for storing said coilable drill string;

a drive means for driving said coilable drill string into the well from said first reel and out of the well to said first reel;

a deflection means for directing said coilable drill string between said first reel and into said well centre;

a top drive;

wherein said coilable drill string is provided with:

a first connection at a first end thereof for connecting the coilable drill string to a bottom-hole-assembly; and a second connection at a second end thereof for directly connecting the coilable drill string to said top drive.

2. Drilling system according to claim 1, wherein said coilable drill string comprises a composite material.

3. Drilling system according to claim 1, wherein said coilable drill string comprises metal.

4. Drilling system according to claim 1 wherein said deflection means is slidable to and from said well centre.

5. Drilling system according to claim 1, wherein said drilling system further comprises a second reel for storing a second coilable drill string.

6. Drilling system according to claim 1, wherein said first reel has a diameter in the range 10-15 metres.

7. Drilling system according to claim 1, wherein said drilling system further comprises a cooling means for cooling said coilable drill string at or near said deflection means.

8. Drilling rig comprising a drilling system according to claim 1.

9. Method for operating a drilling system according to claim 1, said method including the steps of:

placing said first reel and said deflection means in an operating position;

connecting said first end of the coilable drill string to said bottom-hole-assembly;

spooling out said coilable drill string from the first reel for lowering said bottom-hole-assembly into the well;

reaching a target depth;

securing said coilable drill sting in said well centre;

disconnecting said first reel from said second end of the coilable drill string; and connecting said top drive to said second end of the coilable drill string.

10. Method according to claim 9, wherein the step of connecting said top drive to said second end includes the sub-steps of:

presenting a stand to the well centre and connecting said stand, directly or indirectly, to said second end of the coilable drill string; and latching said top drive to the stand.

11. Method according to claim 9, wherein the step disconnecting said first reel from said second end of the coilable drill string includes the step of rotating the coilable drill string on a well-side of the coilable drill string, while keeping said coilable drill string substantially fixed on a reel side of the coilable drill string.

12. Method according to claim 9, wherein the method further comprises the step of drilling the well by rotating said coilable drill string with the top drive.

13. Drilling system according to claim 1, wherein said drilling system further comprises a lubrication means for lubricating said coilable drill string at or near said deflection means.

14. Drilling system for drilling a well, the drilling system having a well centre through which a drill string may be run into and pulled out of the well, said drilling system comprising:

a coilable drill string;

a first reel for storing said coilable drill string;

a drive means for driving said coilable drill string into the well from said first reel and out of the well to said first reel;

a deflection means for directing said coilable drill string between said firsts reel and into said well centre;

a top drive;

wherein said coilable drill is provided with:

a first connection at a first end thereof for connecting the coilable drill string to a bottom-hole-assembly; and a second connection to a second end thereof for connecting the coilable drill string to said top drive, wherein said coilable drill string comprises a plurality of connected drill pipes.

15. Drilling system according to claim 14, wherein said first reel comprises recesses configured to accommodate joints between the connected pipes, said joints having a larger diameter than said drill pipes.

16. Drilling system for drilling a well, the drilling system having a well centre through which a drill string may be run into and pulled out of the well, said drilling system comprising:

a coilable drill string;

a first reel for storing said coilable drill string;

a drive means for driving said coilable drill string into the well from said first reel and out of the well to said first reel;

a deflection means for directing said coilable drill string between said first reel and into said well centre;

a top drive;

wherein said coilable drill is provided with:

a first connection at a first end thereof for connecting the coilable drill string to a bottom-hole-assembly; and a second connection to a second end thereof for connecting the coilable drill string to said top drive, wherein said top drive is connectable to said second end of the coilable drill string via a drill stand.

* * * * *